US010767333B2

(12) United States Patent
Tokuno

(10) Patent No.: US 10,767,333 B2
(45) Date of Patent: Sep. 8, 2020

(54) CONSTRUCTION METHOD FOR FOUNDATION PILE

(71) Applicants: ASAHI ENGINEERING CO., LTD., Ishikawa (JP); AE JAPAN CO., LTD., Ishikawa (JP)

(72) Inventor: Mitsuhiro Tokuno, Ishikawa (JP)

(73) Assignees: ASAHI ENGINEERING CO., LTD., Ishikawa (JP); AE JAPAN CO., LTD., Ishikawa (JP)

( * ) Notice: Subject to any disclaimer, the term of this patent is extended or adjusted under 35 U.S.C. 154(b) by 0 days.

(21) Appl. No.: 14/437,057

(22) PCT Filed: Nov. 8, 2012

(86) PCT No.: PCT/JP2012/079025

§ 371 (c)(1),
(2) Date: Apr. 20, 2015

(87) PCT Pub. No.: WO2014/073078

PCT Pub. Date: May 15, 2014

(65) Prior Publication Data

US 2015/0275455 A1 Oct. 1, 2015

(51) Int. Cl.
*E02D 5/34* (2006.01)
*E02D 5/66* (2006.01)
(Continued)

(52) U.S. Cl.
CPC ..... *E02D 5/34* (2013.01); *E02D 5/665* (2013.01); *E02D 7/00* (2013.01); *E02D 27/12* (2013.01)

(58) Field of Classification Search
CPC combination set(s) only.
See application file for complete search history.

(56) References Cited

U.S. PATENT DOCUMENTS 1,265,164 A * 5/1918 Barry et al. ..... E02D 5/44 405/237
3,805,535 A * 4/1974 Van Weele ..... E02D 5/38 405/237
(Continued)

FOREIGN PATENT DOCUMENTS

CH 000683197 A5 * 1/1994
GB 1315075 A * 4/1973 ..... E02D 5/00
(Continued)

OTHER PUBLICATIONS

International Search Report dated Dec. 4, 2012 in International Application No. PCT/JP2012/079025.

*Primary Examiner* — Kyle Armstrong
(74) *Attorney, Agent, or Firm* — Wenderoth, Lind & Ponack, L.L.P.

(57) ABSTRACT

The present invention enables easy construction of a foundation pile having a rigid structure even at a site where a pile produced in a factory cannot be brought in. The tube 1 having a forming material filling port 1*a* at a top end and a closed bottom 1*b* at a bottom end is set in a suspended state, and foundation pile forming material 4 is filled from the forming material filling port 1*a* into the tube 1 in the suspended state. A composite foundation pile 5 in which the tube 1 and the filled forming material 4 are integrated is formed, and the composite foundation pile 5 is driven into the ground 13 or inserted into a borehole 12 formed on the ground 13.

2 Claims, 23 Drawing Sheets

(51) Int. Cl.
*E02D 7/00* (2006.01)
*E02D 27/12* (2006.01)

(56) References Cited

U.S. PATENT DOCUMENTS 4,011,728 A * 3/1977 Turzillo ..... E02B 3/127
405/222
4,594,206 A * 6/1986 Grafton ..... E02B 3/06
264/257
5,593,623 A * 1/1997 Mohss ..... E04G 13/021
249/48

FOREIGN PATENT DOCUMENTS

| | | |
|---|---|---|
| JP | 64-75713 | 3/1989 |
| JP | 2000-104247 | 4/2000 |
| JP | 2002-13139 | 1/2002 |
| JP | 2010-90592 | 4/2010 |
| JP | 4919631 | 4/2012 |

* cited by examiner

CONSTRUCTION METHOD FOR FOUNDATION PILE

TECHNICAL FIELD

The present invention relates to a construction method for a foundation pile configured to support a civil engineering structure such as a bridge, and an architectural structure such as a building or a house.

BACKGROUND ART

According to fifth and sixth embodiments of Patent Literature 1 below, a construction method for a foundation pile is disclosed, in which a cylindrical body formed of a carbon fiber sheet is suspended and moved down into a borehole formed on the ground, and concrete is poured into the suspended cylindrical body, and the poured concrete is integrated with the cylindrical body to form the foundation pile.

Further, according to the same Patent Literature, the cylindrical body may be formed in a bag-like shape by closing a bottom portion of the cylindrical body, but the Patent Literature merely discloses that the concrete is poured while supporting the bottom portion of the cylindrical body with a bottom surface of the borehole. Basically, this technology is based on a technical idea of pouring the concrete into the cylindrical body including both a top end and a bottom end opened.

CITATION LIST

Patent Literature

Patent Literature 1: JP 4919631 B1

SUMMARY OF INVENTION

Technical Problem

As described above, the method of the Patent Literature 1 is the method of pouring concrete into a cylindrical body suspended and moved down into the borehole, namely, into the cylindrical body placed on the bottom surface of the borehole.

Further, according to the method of the same Patent Literature, the concrete is poured while keeping a shape of a peripheral side portion of the cylindrical body by curing a carbon fiber sheet forming the peripheral side portion of the cylindrical body by applying a curing agent such as an epoxy resin, and providing a shape keeping member such as a ring member and a casing pipe on an inner and outer sides of the same peripheral side portion.

In the case of forming the cylindrical body in a bag-like shape by closing the bottom portion, the configuration is the same.

Solution to Problem

The present invention provides a construction method for a foundation pile in which the foundation pile is formed by filling a foundation pile forming material while a tube is set in a suspended state different from the method in the related art in which the foundation pile is constructed inside the borehole, and enables easy construction of the foundation pile having a rigid structure even at a site where a pile produced in a factory cannot be brought in.

In other words, the construction method for the foundation pile according to the present invention enables easy construction of the foundation pile having the rigid structure by: setting, in a suspended state, the tube having a forming material filling port at a top end and a closed bottom at a bottom end; filling the foundation pile forming material from the forming material filling port into the tube in the suspended state; forming a composite foundation pile in which the tube and the filled forming material are integrated; and driving the composite foundation pile into the ground or inserting the composite foundation pile upright into a borehole formed in the ground.

Preferably, the tube is set in the suspended state with the bottom end supported, or the tube is set in the suspended state with the bottom end free.

Further, a construction method for a foundation pile according to the present invention enables easy construction of the foundation pile having the rigid structure by: setting, in a suspended state, the tube having a forming material filling port at a top end and a closed bottom at a bottom end; inserting the tube into a borehole formed on the ground while foundation pile forming material is filled from the forming material filling port into the tube in the suspended state; and forming a composite foundation pile in which the tube and the filled forming material are integrated inside the borehole.

Preferably, the foundation pile having higher rigidity is constructed by reinforcing an entire length of the tube with a reinforcing member formed of a linear member or a belt-like member.

Further, annular reinforcing members are disposed at intervals in a longitudinal direction of the tube, thereby ensuring reinforcement of the tube.

Further, the tube in the suspended state is caused to bulge outward between the reinforcing members due to fill pressure of the forming material, and the bulging portion reinforces holding force to the ground.

Preferably, the tube is formed of a fiber knitted body, and rigidity is suitably reinforced by integrating the tube with the forming material.

Advantageous Effects of Invention

According to the present invention, the composite foundation pile having high rigidity can be easily constructed.

DESCRIPTION OF EMBODIMENTS

Preferable embodiments of the present invention will be described based on FIGS. 1 to 14C.

<Tube Used in Construction Method for Foundation Pile According to Present Invention>

Figure 1:
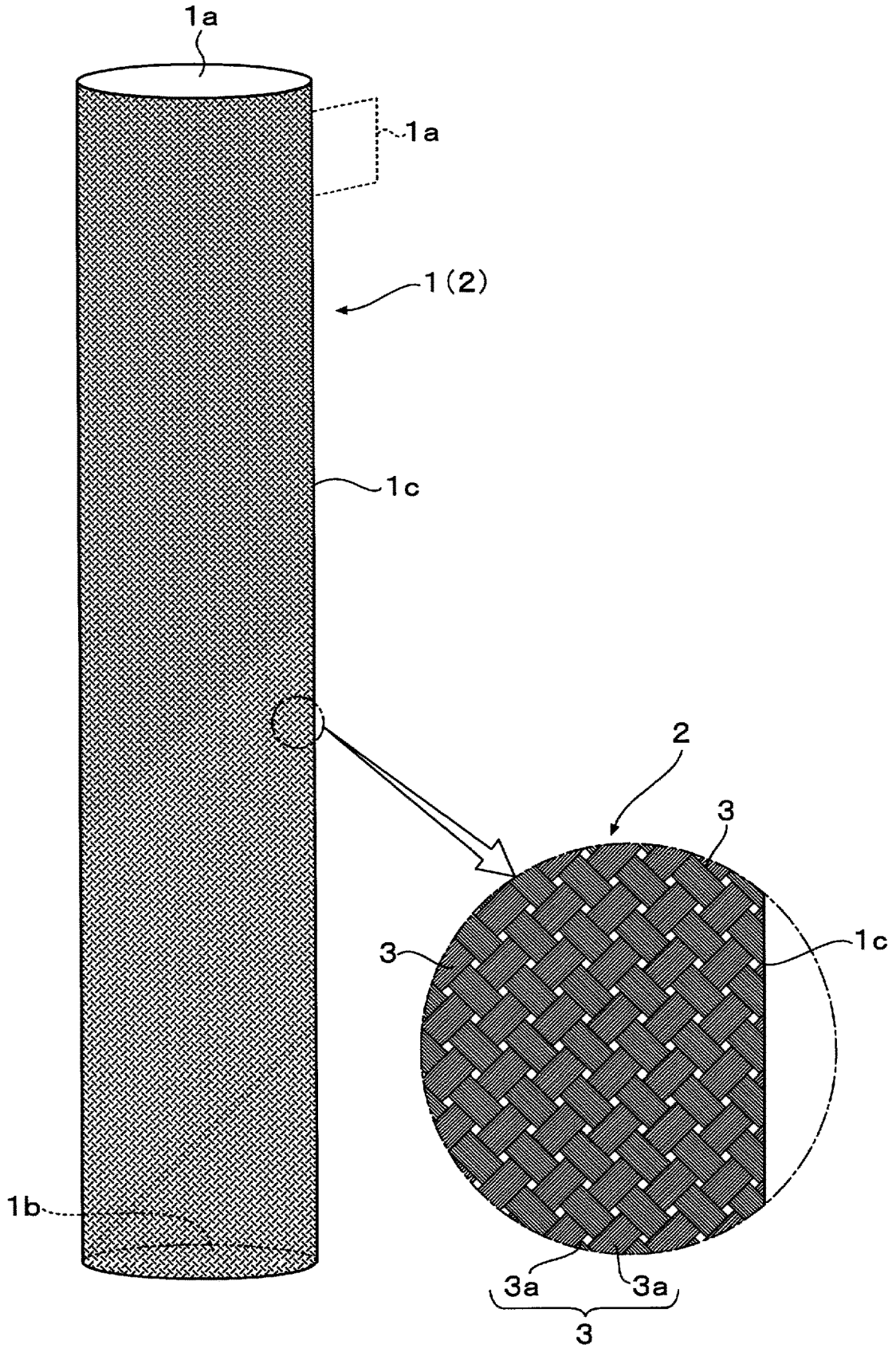
FIG. 1 is a perspective view illustrating a tube used in a construction method for a foundation pile according to the present invention.

First, a tube 1 used in a construction method for a foundation pile according to the present invention will be described. As illustrated in FIG. 1, the tube 1 is formed of a material having flexibility, and has a structure including a forming material filling port 1*a* at a top end (one end) and a closed bottom 1*b* at a bottom end (the other end), and further includes a cylinder forming portion 1*c* between the top end and the bottom end.

Preferably, the tube 1 is formed of a fiber knitted body 2 as illustrated in an enlarged drawing in FIG. 1. The fiber knitted body 2 is, for example, multiply knitted out of a bundled fiber 3 formed by bundling fibers 3*a*, and forms the tube 1 having high water-tightness.

For the fiber 3*a*, a plastic fiber, a carbon fiber, an aramid fiber, a metal fiber, etc. are used, for example. The fiber knitted body 2 is knitted out of the bundled fibers 3*a* or the single fiber 3*a*. More specifically, the fiber knitted body 2 is formed in a sheet-like shape by flat knitting or in a cylindrical shape by round knitting, etc.

In the case of forming the tube 1 with the fiber knitted body 2 knitted in the sheet-like shape, the tube 1 is formed by making the sheet-like fiber knitted body 2 into a cylindrical shape. The bottom end of the tube 1 formed of the fiber knitted body 2 made into the cylindrical shape is closed by bonding or stitching, thereby forming the closed bottom 1*b*. In the case of forming the tube 1 with the fiber knitted body 2 knitted in the cylindrical shape, the bottom end of the tube 1 formed of the cylindrical fiber knitted body 2 is closed by bonding or stitching, thereby forming the closed bottom 1*b*. Note that the present invention does not exclude a case where the closed bottom 1*b* and the cylinder forming portion 1*c* are separate members, and closed bottom 1*b* is integrated with the cylinder forming portion 1*c* by bonding or stitching.

Further, the top end of the tube 1 in FIG. 1 is opened and provided as the forming material filling port 1*a*. Alternatively, a top end opening is closed as indicated by a dotted line in FIG. 1, and the forming material filling port 1*a* is provided below the closed portion.

Figure 2A:
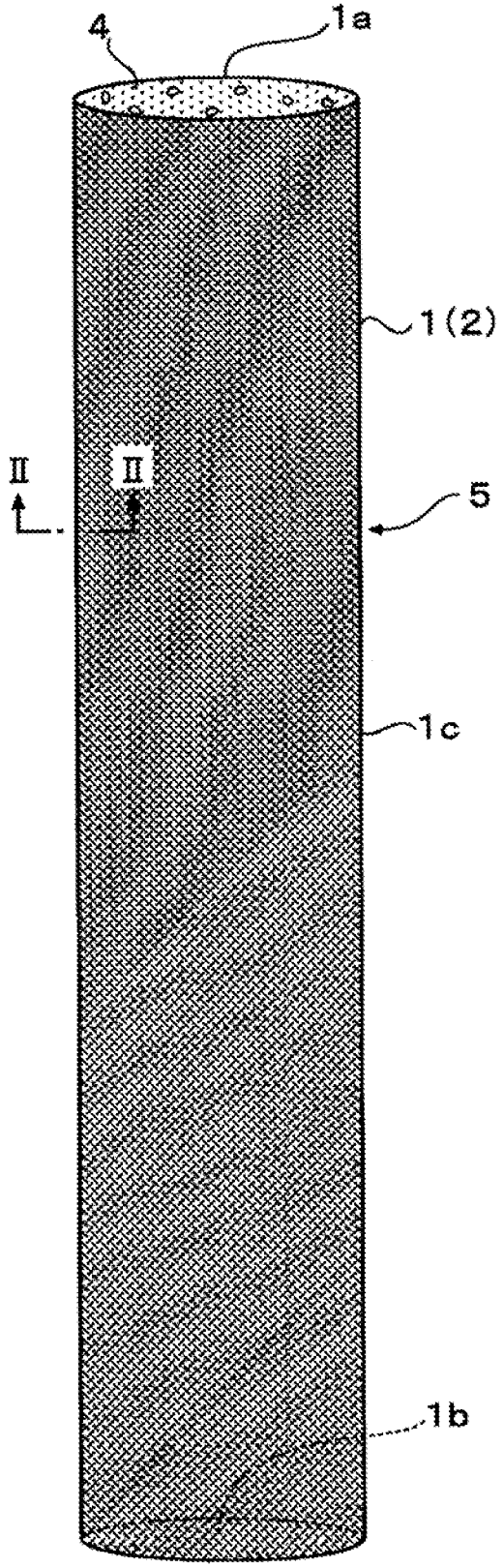
FIG. 2A is perspective view illustrating a state in which a foundation pile forming material is filled into the tube.
Figure 2B:
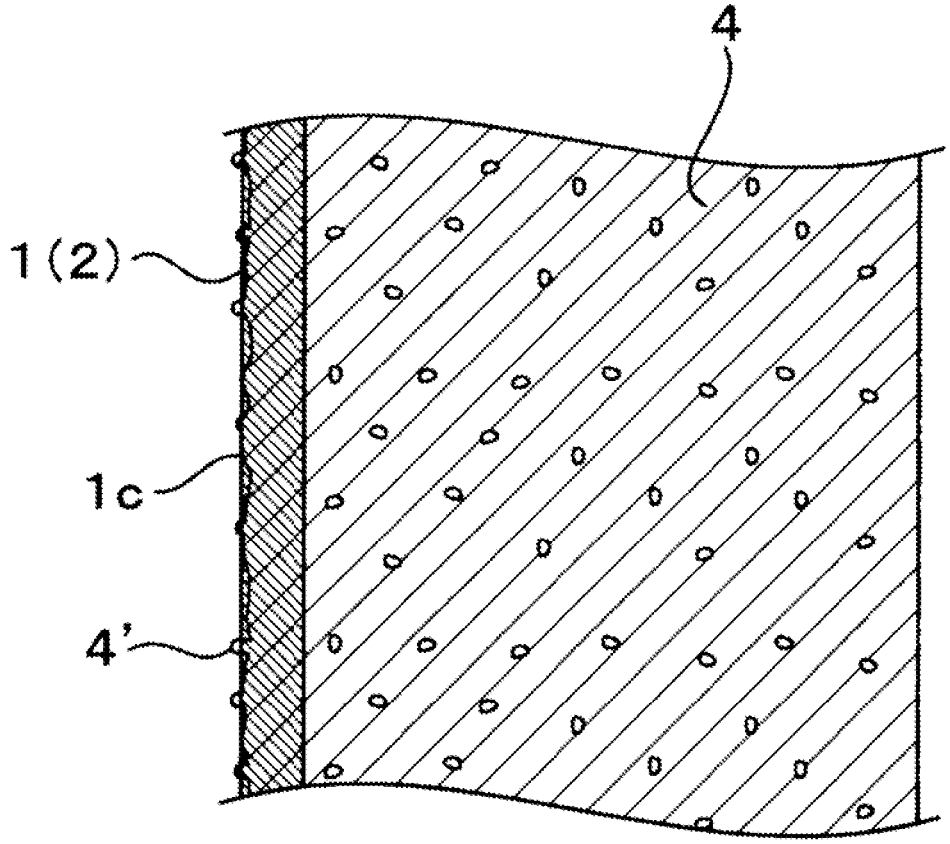
FIGS. 2B and 2C are cross-sectional views illustrating states in which a cylinder forming portion of the tube and filled forming material are integrated.

As illustrated in FIG. 2A, foundation pile forming material 4 is filled into the tube 1 formed of the fiber knitted body 2 as described later, thereby filling the forming material 4 such that components 4' of the forming material 4 slightly ooze outward from the cylinder forming portion 1*c* formed of the fiber knitted body 2 due to a fill pressure of the forming material 4, as illustrated in FIG. 2B. As a result, the fiber knitted body 2 and the filled forming material 4, namely, the tube 1 and the filled forming material 4 are integrated, and a composite foundation pile 5 having reinforced rigidity is formed as illustrated in FIG. 2A.

Figure 2C:
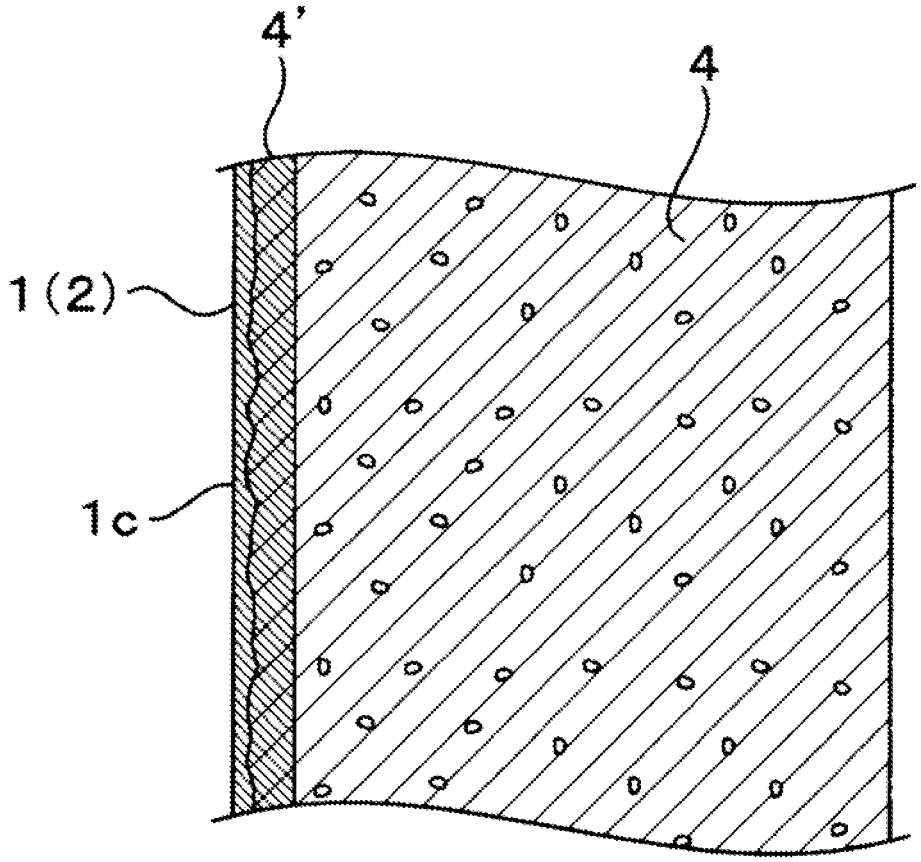

Alternatively, as illustrated in FIG. 2C, the forming material 4 is filled such that the components 4' of the forming material 4 infiltrate the inside of the cylinder forming portion 1*c* formed of the fiber knitted body 2. As a result, the fiber knitted body 2 and the filled forming material 4, namely, the tube 1 and the filled forming material 4 are integrated, and the composite foundation pile 5 having reinforced rigidity is formed as illustrated in FIG. 2A.

Figure 3:
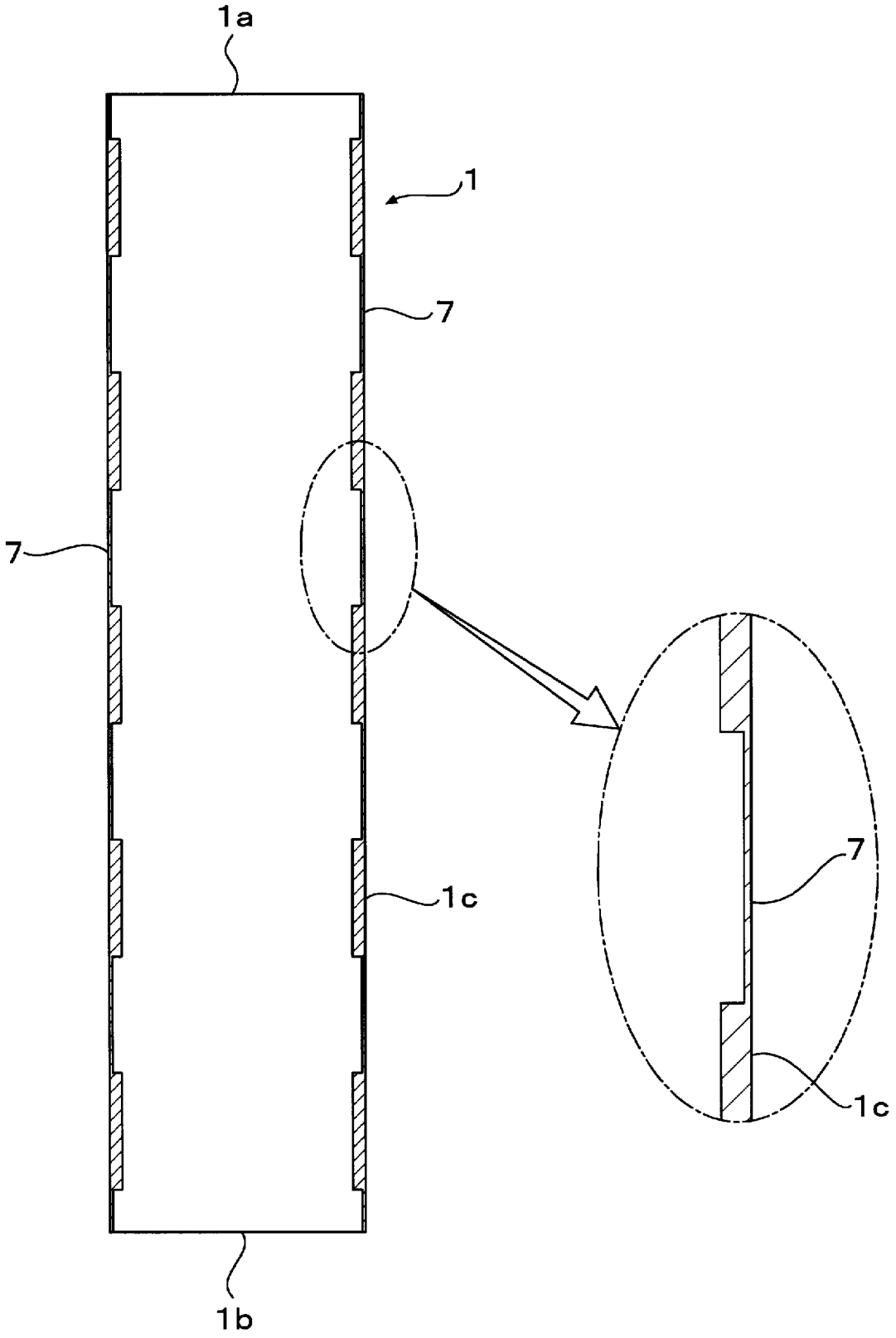
FIG. 3 is a cross-sectional view illustrating an example in which a thin cylinder forming portion is formed at the cylinder forming portion of the tube.

Note that the tube 1 is not limited to the fiber knitted body 2 in the case where the tube has flexibility as described above, and a case where a tube 1 is made from a material, such as a synthetic resin or a synthetic rubber, durable to filling work of the forming material in the later-described suspended state may also be included, as illustrated in FIG. 3.

Figure 4:
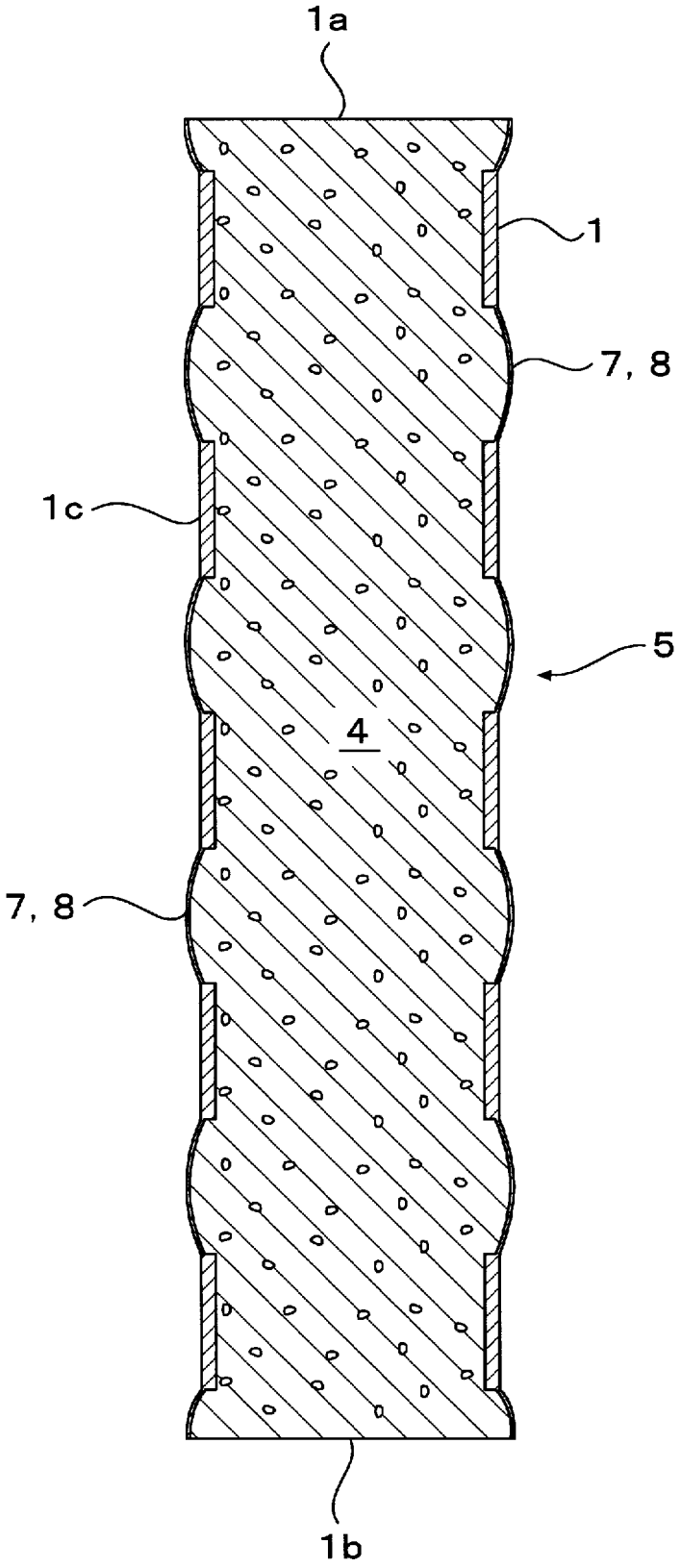
FIG. 4 is a cross-sectional view illustrating a state of filling the foundation pile forming material into the tube exemplified in FIG. 3.

Further, as an embodiment of the tube 1, the cylinder forming portion 1*c* of the tube 1 is formed to have equal thickness, or a thin cylinder forming portion 7 is formed at the cylinder forming portion 1*c* as illustrated in FIG. 3. The thin cylinder forming portions 7 are formed at multiple places at intervals in a longitudinal direction. By filling the forming material 4 into the tube 1 having the thin cylinder forming portions 7, the thin cylinder forming portion 7 is made to bulge by the fill pressure of the forming material 4 to form a bulging portion 8 as illustrated in FIG. 4 so as to reinforce engagement with the ground 13 described later.

Figure 5:
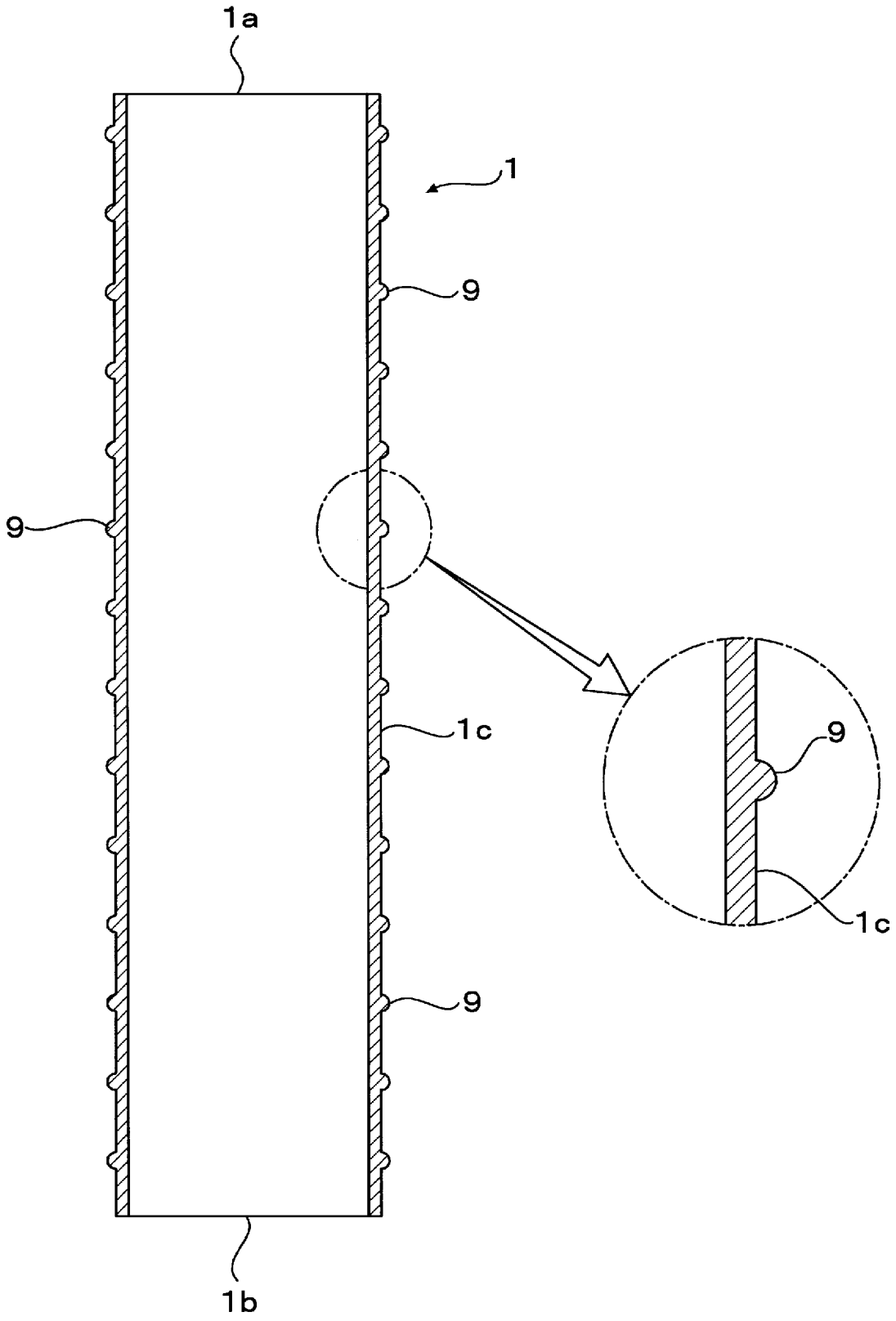
FIG. 5 is a cross-sectional view illustrating an example in which a projection is formed at the cylinder forming portion of the tube.

Alternatively, as exemplified in FIG. 5, a projection 9 is provided on an outer surface of the cylinder forming portion 1*c* of the tube 1. The projections 9 are provided at multiple places on the outer peripheral surface of the cylinder forming portion 1*c*, and engagement with the ground 13 is reinforced at the projections 9.

Figure 6A:
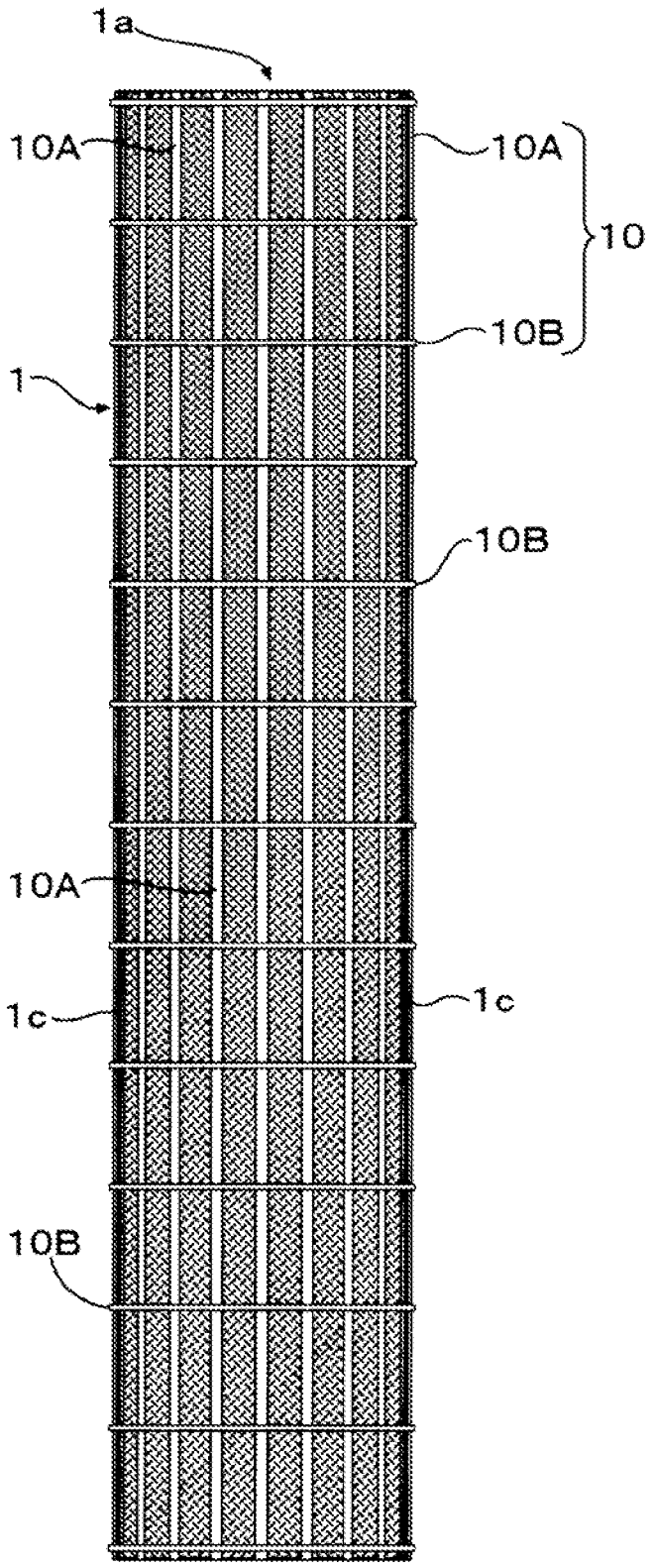
FIG. 6A is a front view illustrating an example in which the cylinder forming portion of the tube is reinforced with a reinforcing member.
Figure 6B:
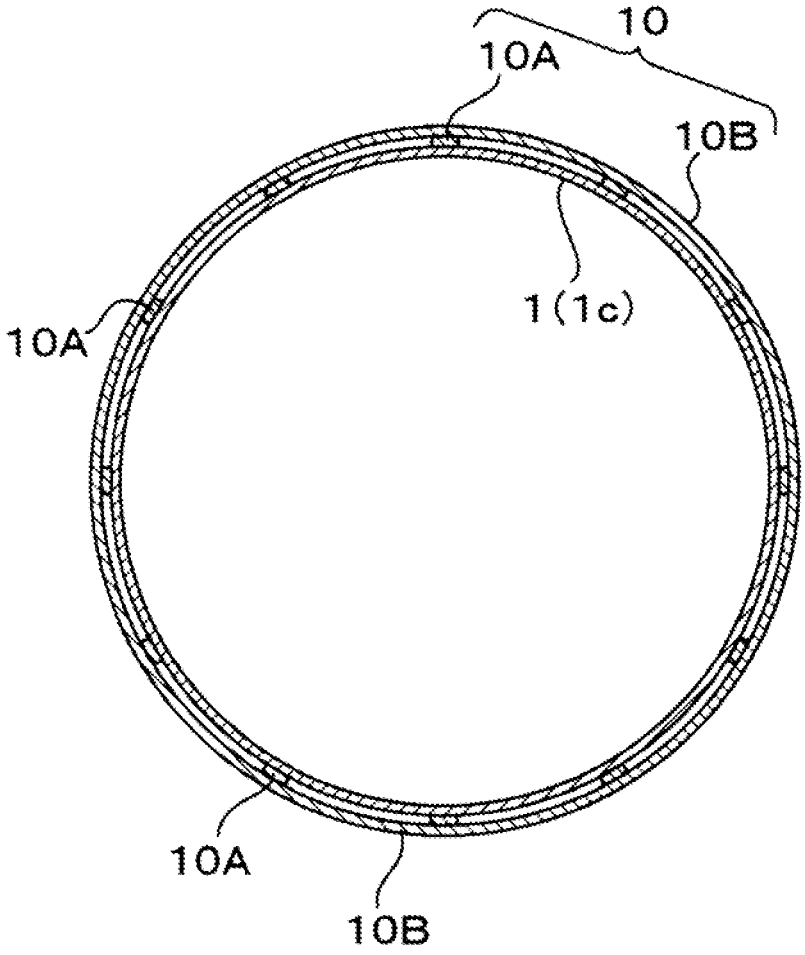
FIG. 6B is an enlarged cross-sectional view in a horizontal direction of the tube in the same example.

Preferably, as illustrated in FIGS. 6A and 6B, in the tube 1 described in each of the above-described examples, an entire length of an inner peripheral surface or an outer peripheral surface of the cylinder forming portion 1*c* of the tube 1 can be reinforced by a linear or belt-like reinforcing member 10.

More specifically, a reinforcing member 10 includes: vertical reinforcing members 10A disposed along the longitudinal direction of the outer peripheral surface of the cylinder forming portion 1*c* of the tube 1; and annular horizontal reinforcing members 10B disposed along a peripheral direction of the outer peripheral surface of the cylinder forming portion 1*c* as illustrated in FIGS. 6A and 6B. The vertical reinforcing members 10A are arranged at intervals in the peripheral direction of the cylinder forming portion 1*c*, and the horizontal reinforcing members 10B are arranged at intervals in the longitudinal direction of the cylinder forming portion 1*c*.

Figure 7:
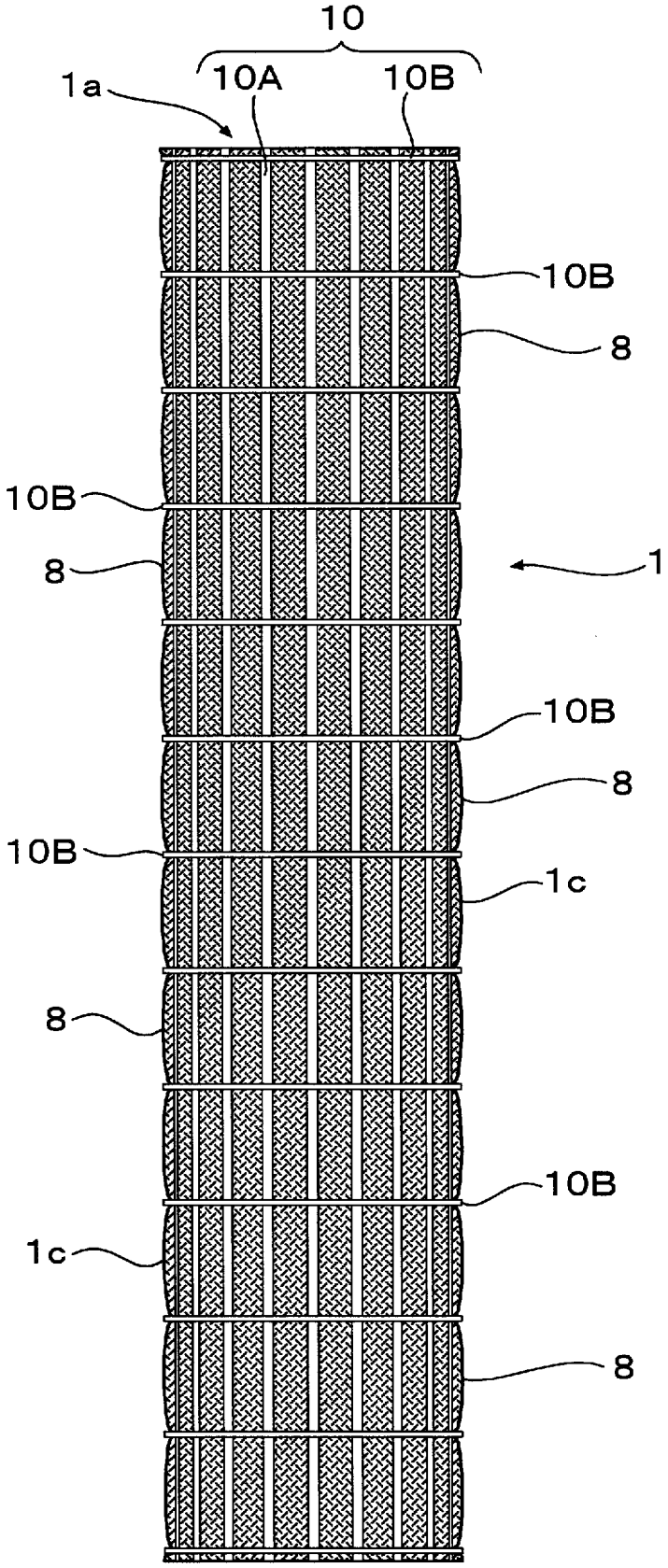
FIG. 7 is a front view illustrating a state in which the foundation pile forming material is filled into the tube exemplified in FIG. 6.

As illustrated in FIG. 7, when the forming material 4 is filled into the tube 1 reinforced by the reinforcing member 10, portions of the cylinder forming portion 1*c* of the tube 1 between the above reinforcing members 10A and 10B, namely, the portions not reinforced by the vertical reinforcing members 10A and horizontal reinforcing members 10B are made to bulge due to the fill pressure of the forming material 4 to form the bulging portions 8, thereby reinforcing engagement with the ground 13.

First Embodiment

According to a construction method for a foundation pile according to the present embodiment, a tube 1 exemplified above is used, and as illustrated in FIGS. 8 to 11, the tube 1 including a forming material filling port 1*a* at a top end and a closed bottom 1*b* at a bottom end is set in a suspended state by a suspension means 11 on the ground. In this suspended state, foundation pile forming material 4 is filled into the tube 1 from the forming material filling port 1*a* and curing is promoted in the tube 1, more specifically, curing is promoted in the forming material 4 inside the tube 1 that keeps a tensile state of a cylinder forming portion 1*c*. As a result, the tube 1 and the filled forming material 4 are integrated, thereby forming and a composite foundation pile 5 having reinforced rigidity.

For the suspension means 11, a known derrick, a crane, etc. can be used. The suspension means is not specifically limited when the suspension means 11 is at least capable of setting the tube 1 in the suspended state and the forming material 4 can be filled into the tube 1 in the suspended state. Further, considering curing time of the forming material 4 filled into the tube 1, a case of preparing a plurality of suspension means 11 is not excluded.

For the foundation pile forming material 4, a material which is cured from a fluid state to a solid state is used. For example, in addition to known cement mortar and concrete, a forming material made by mixing waste material (slag, mining residues, etc.) and cement or resin, and so on are also used.

According to the present invention, the tube 1 is set in the suspended state with the bottom end supported as illustrated in FIGS. 8 to 11 to ensure stable filling of the forming material 4.

Figure 8:
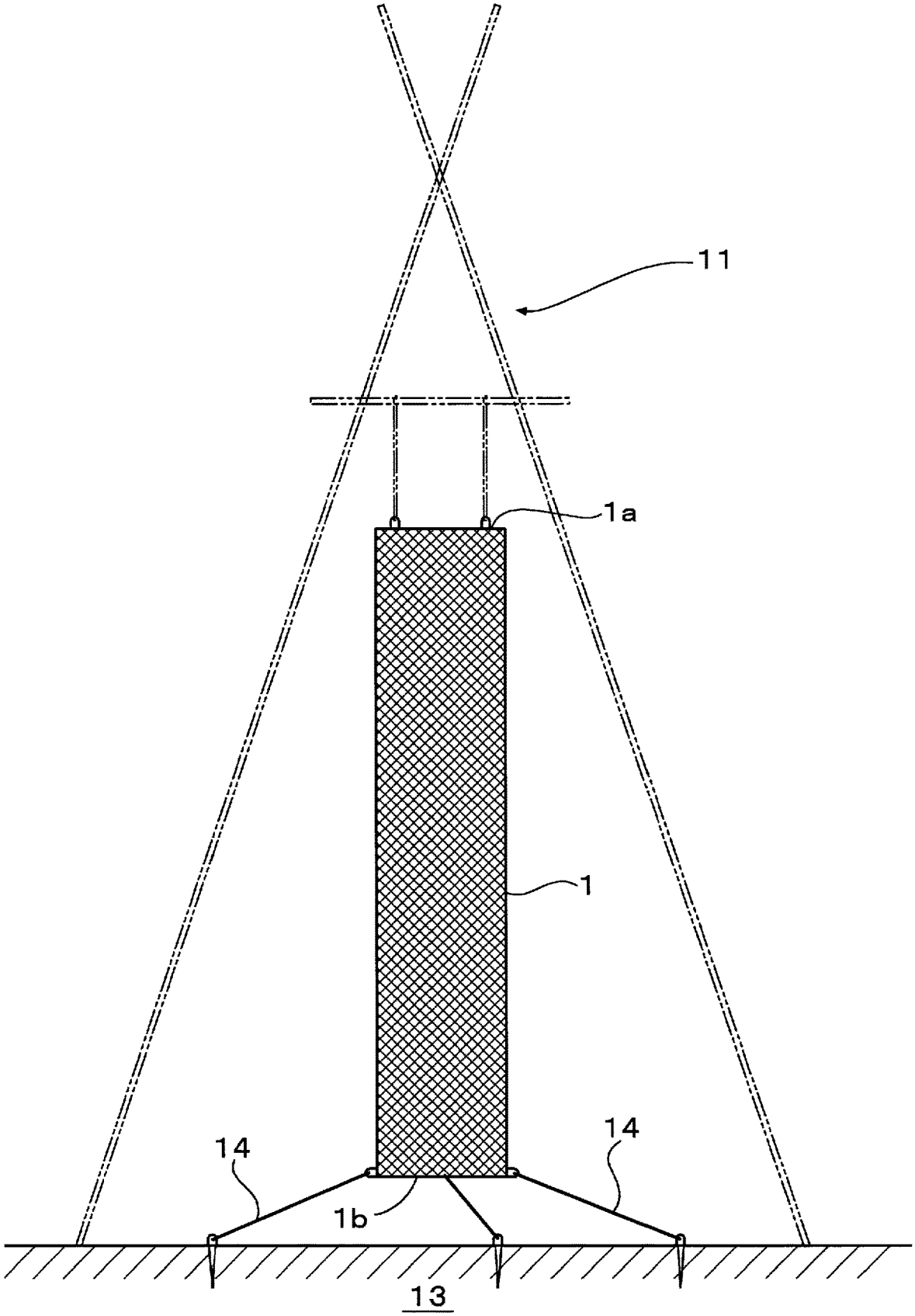
FIG. 8 is a front view illustrating a suspended state of the tube.

FIG. 8 is a diagram illustrating an example in which the bottom end of the tube 1 is supported by being pulled with support bars 14 from multiple directions. One end of the support bar 14 is engaged with the bottom end of the tube 1 by an engagement means such as a hook, and the other end is fixed to the ground by a fixing stake or the like. In the case of this example, a gap is formed between the bottom end of the tube 1 and the ground.

Figure 9:
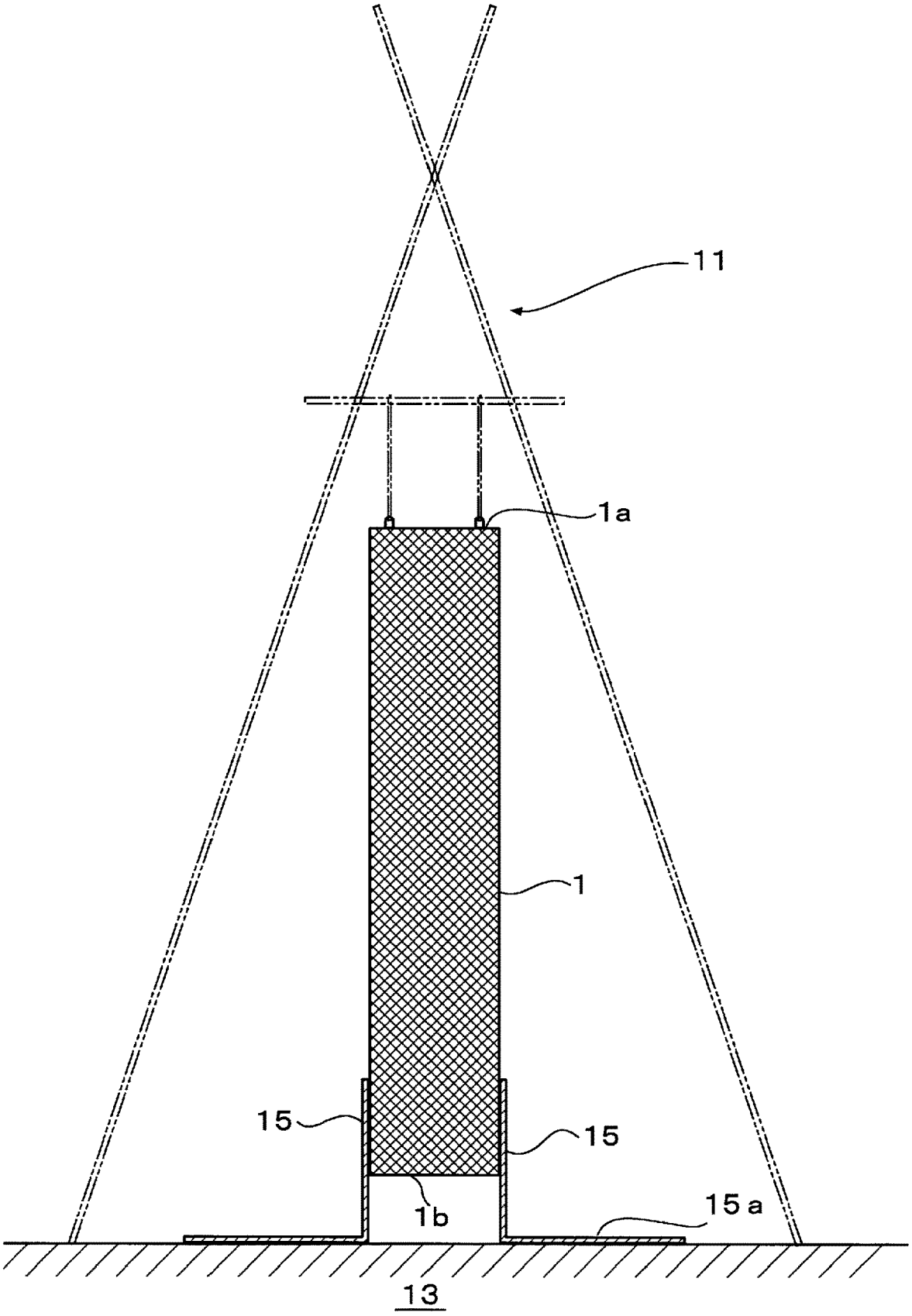
FIG. 9 is an explanatory diagram illustrating an example in which the tube is set in the suspended state with a bottom end thereof supported by a support member.

Further, FIG. 9 is a diagram illustrating an example in which the bottom end of the tube 1 is supported by a cylindrical support member 15 attached with a flange 15*a*. The bottom end of the tube 1 is controlled at a cylinder inner peripheral surface of the cylindrical support member 15 to be set in the suspended state. In the case of this example, the gap is also formed between the bottom end of the tube 1 and the ground.

Figure 10:
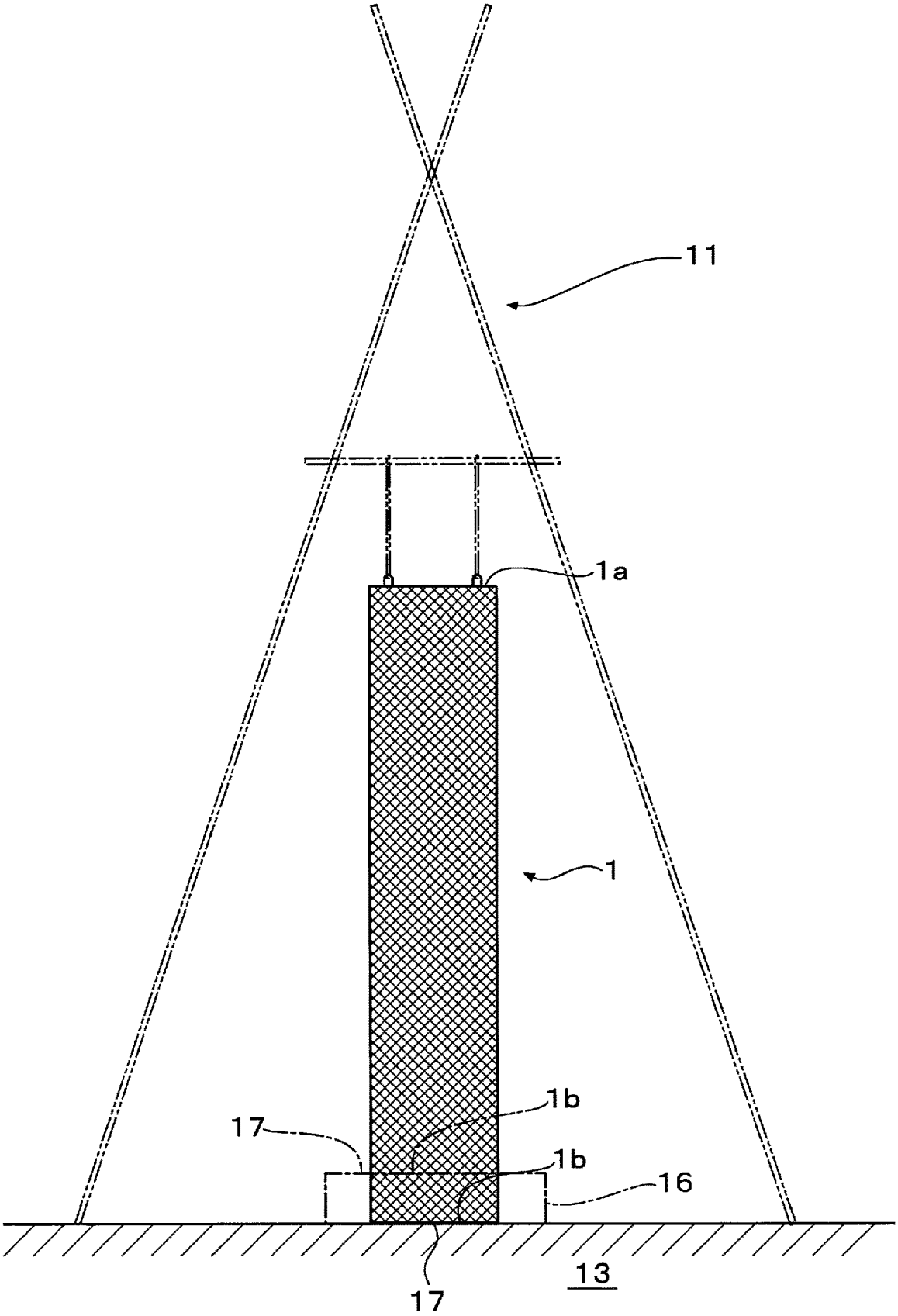
FIG. 10 is an explanatory diagram illustrating an example in which the tube is set in the suspended state with the bottom end thereof supported by the ground or a platform surface of a load platform.

Further, FIG. 10 is a diagram illustrating an example in which the tube 1 is set in the suspended state with the bottom end of the tube 1 supported in a state contacting the ground 13 or a platform surface 17 of a load platform 16. In this example, after the forming material 4 is filled, the platform surface 17 receives a partial weight of the tube 1 and the forming material 4 to reduce the weight applied to the suspension means 11.

Figure 11:
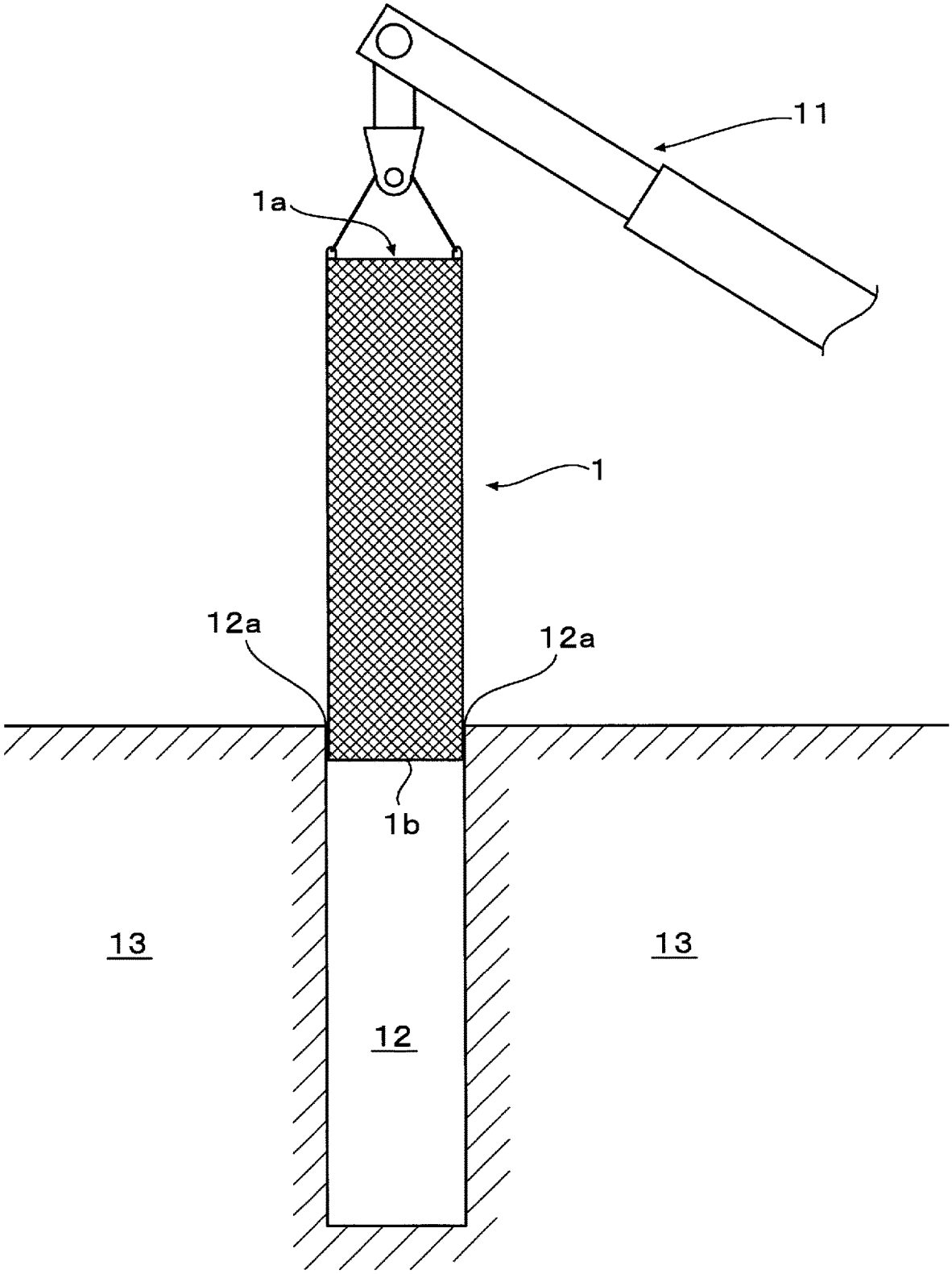
FIG. 11 is an explanatory diagram illustrating an example in which the tube is set in the suspended state with the bottom end thereof supported by an inner peripheral surface of a hole edge of a borehole formed on the ground.

Moreover, FIG. 11 is a diagram illustrating an example in which the bottom end of the tube 1 is inserted into a borehole 12 excavated on the ground while the tube 1 is suspended, and the bottom end is controlled and supported at an inner peripheral surface of a hole edge 12*a* of the borehole 12. As described later, the tube 1 is directly inserted into the borehole 12 upright after the filled forming material 4 is filled into the tube 1 and the forming material 4 is cured or semi-cured. The semi-cured state referred here indicates a case where a core portion of the filled forming material 4 is not cured yet.

According to the present invention, as exemplified above, the tube 1 is set in the suspended state with the bottom end supported, and additionally, the forming material 4 can be filled into the tube 1 while the bottom end of the tube 1 is set free, more specifically, while the tube 1 is simply set in the suspended state.

After a while, curing of the forming material 4 is promoted inside the tube 1 while the tube is kept in the suspended state, and the tube 1 and the filled forming material 4 are integrated, thereby forming the composite foundation pile 5 having reinforced rigidity.

According to the present invention, the plurality of suspension means 11 is prepared and a plurality of the tubes 1 is simultaneously set in the suspended state, and a plurality of the composite foundation piles 5 is formed by filling the forming material 4 into each of the plurality of tubes 1.

Figure 12A:
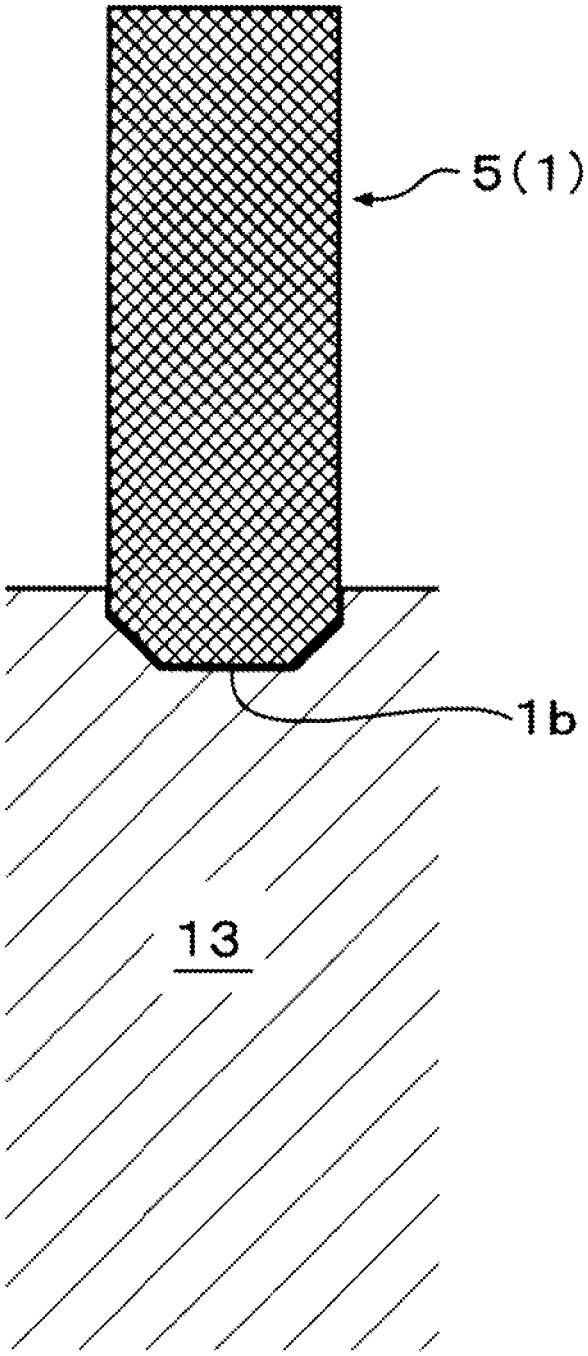
FIGS. 12A to 12C are explanatory diagrams illustrating an exemplary sequential procedure in which a composite foundation pile is constructed by being driven into the ground.
Figure 12B:
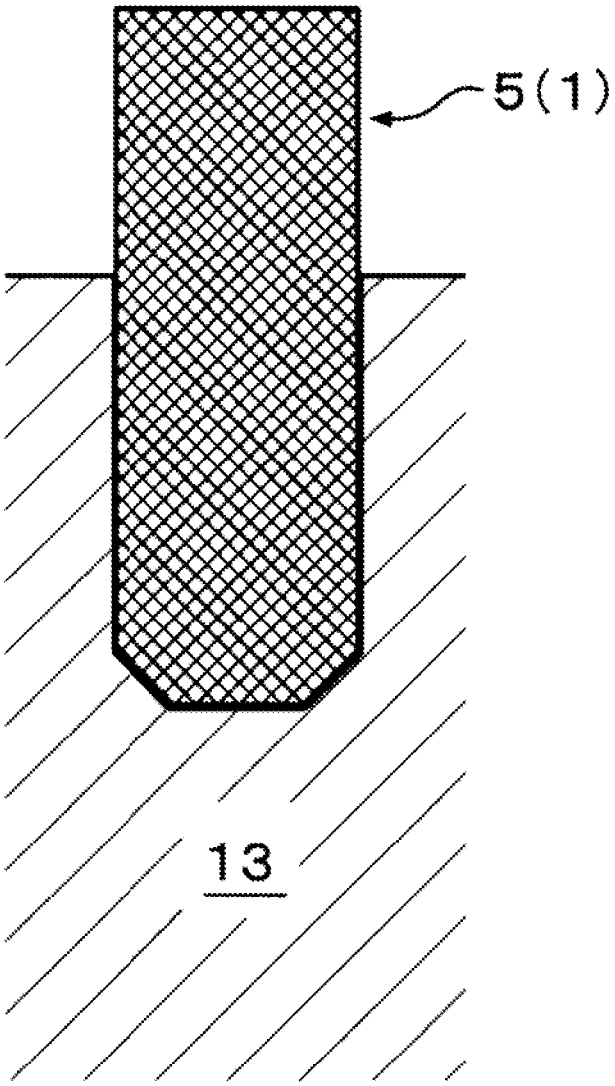
Figure 12C:
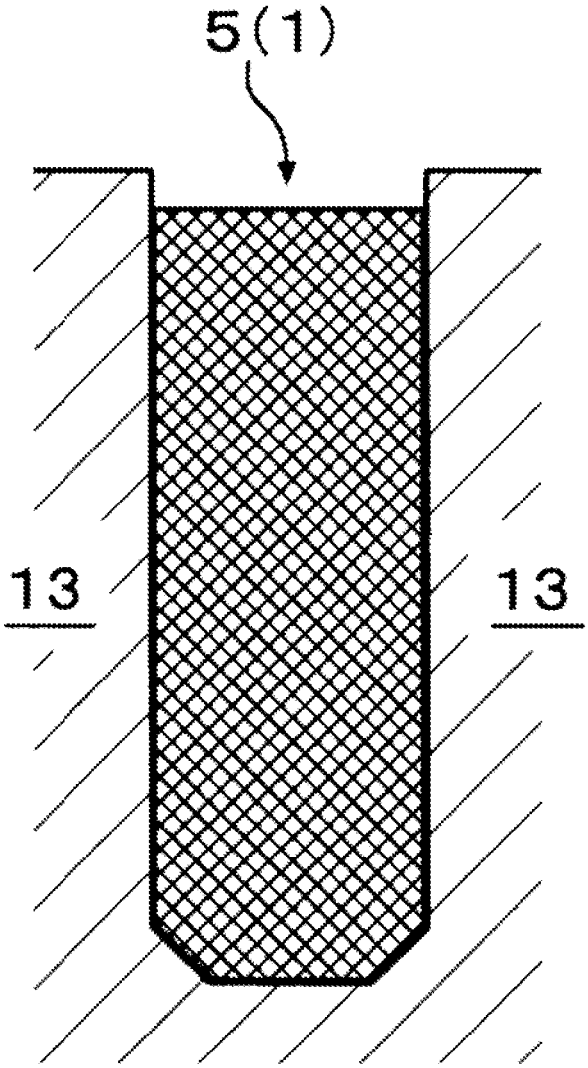

Next, as illustrated in FIGS. 12A to 12C, the composite foundation pile 5 in which the filled forming material 4 in the tube 1 is cured is directly driven into the ground 13. In this case, a case where the closed bottom 1*b* of the tube 1 is tapered as illustrated in FIG. 12 and the filled forming material 4 is cured in the tapered shape so as to facilitate the driving work is not excluded. Preferably, the tube 1 is set in the suspended state immediately above a driving point by the suspension means 11, and directly driven into the point.

Figure 13A:
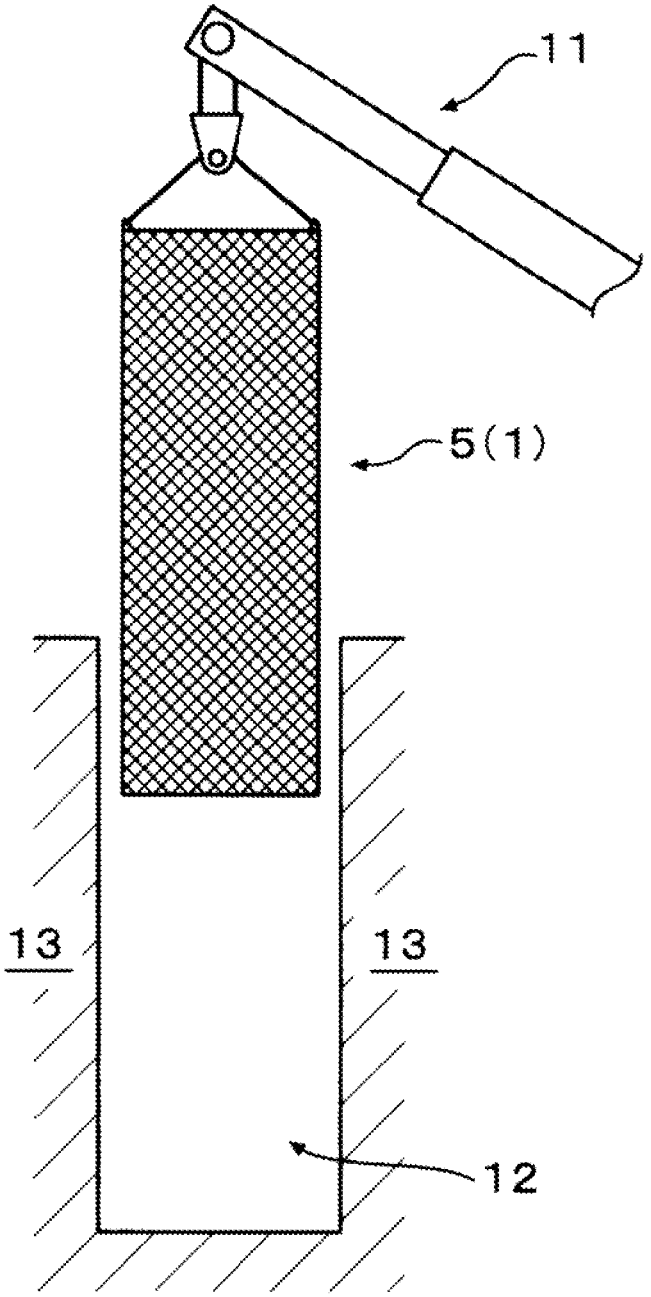
FIGS. 13A to 13C are explanatory diagrams illustrating an exemplary sequential procedure in which the composite foundation pile is constructed by being inserted upright into the borehole formed on the ground.
Figure 13B:
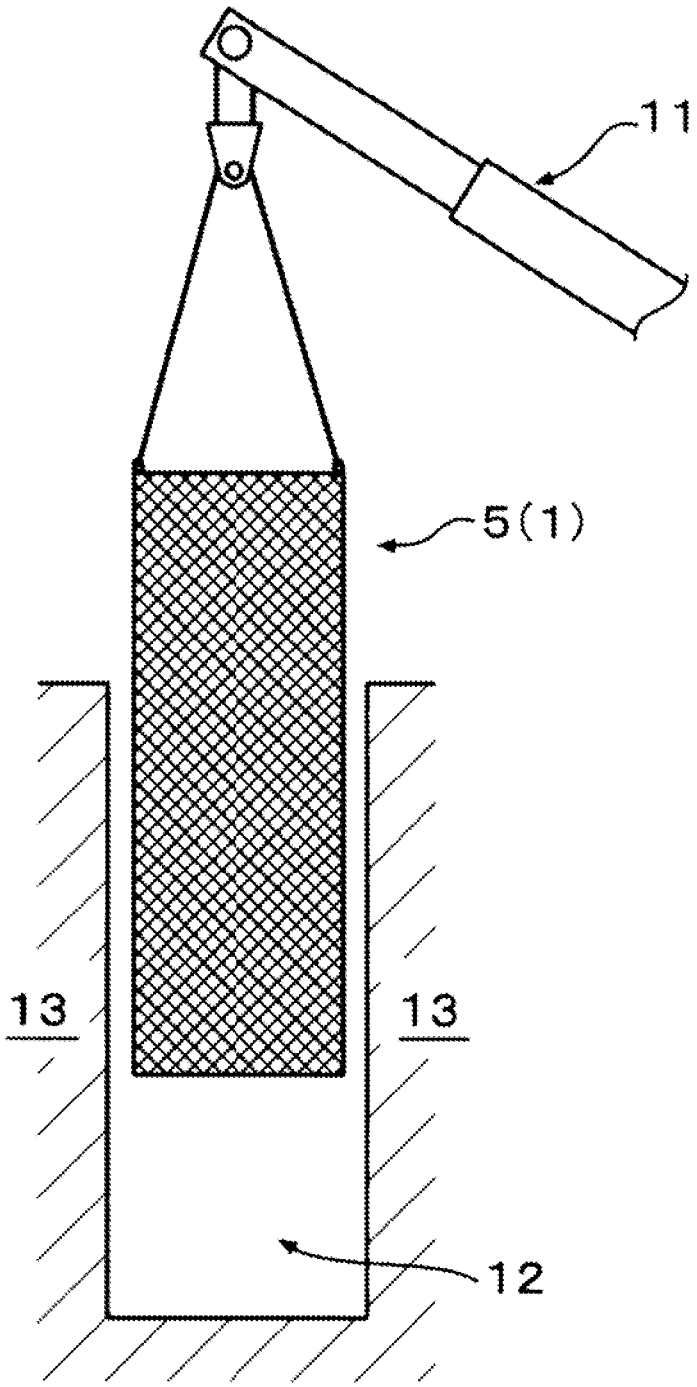
Figure 13C:
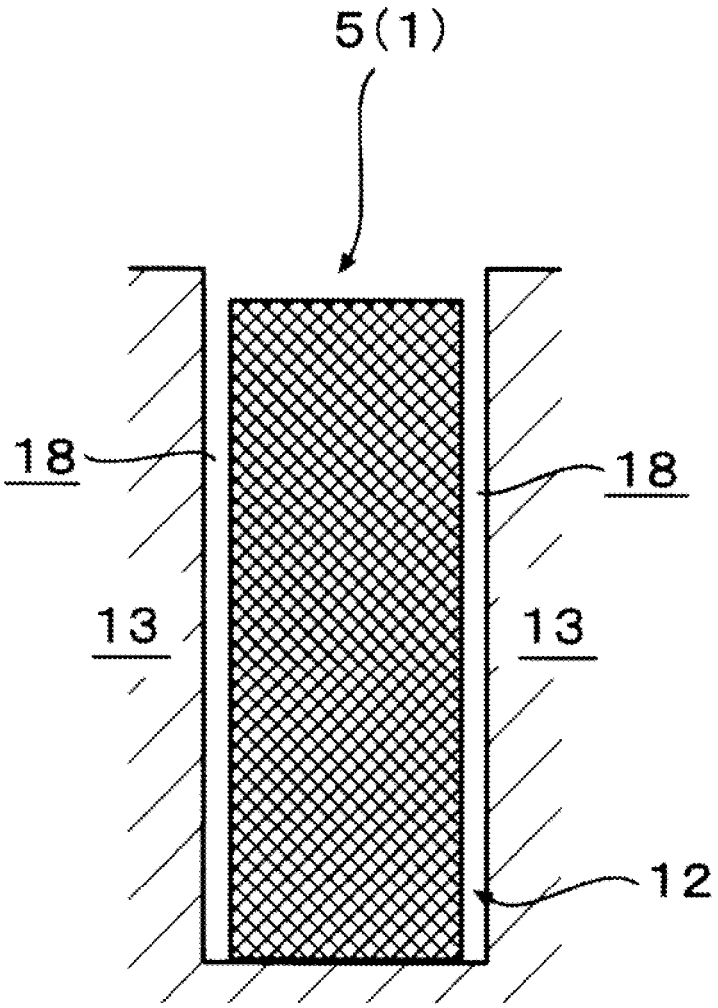

Alternatively, as illustrated in FIGS. 13A to 13C, the composite foundation pile 5 in which the filled forming material 4 in the tube 1 is cured or semi-cured is inserted upright into the borehole 12 formed on the ground 13. In this case, the borehole 12 is formed to have a diameter larger than the tube 1, and soil is backfilled into an annular space 18 between an inner peripheral surface of the borehole 12 and an outer peripheral surface of the composite foundation pile 5 as illustrated in FIG. 13C, thereby completing construction.

Second Embodiment

Figure 14A:
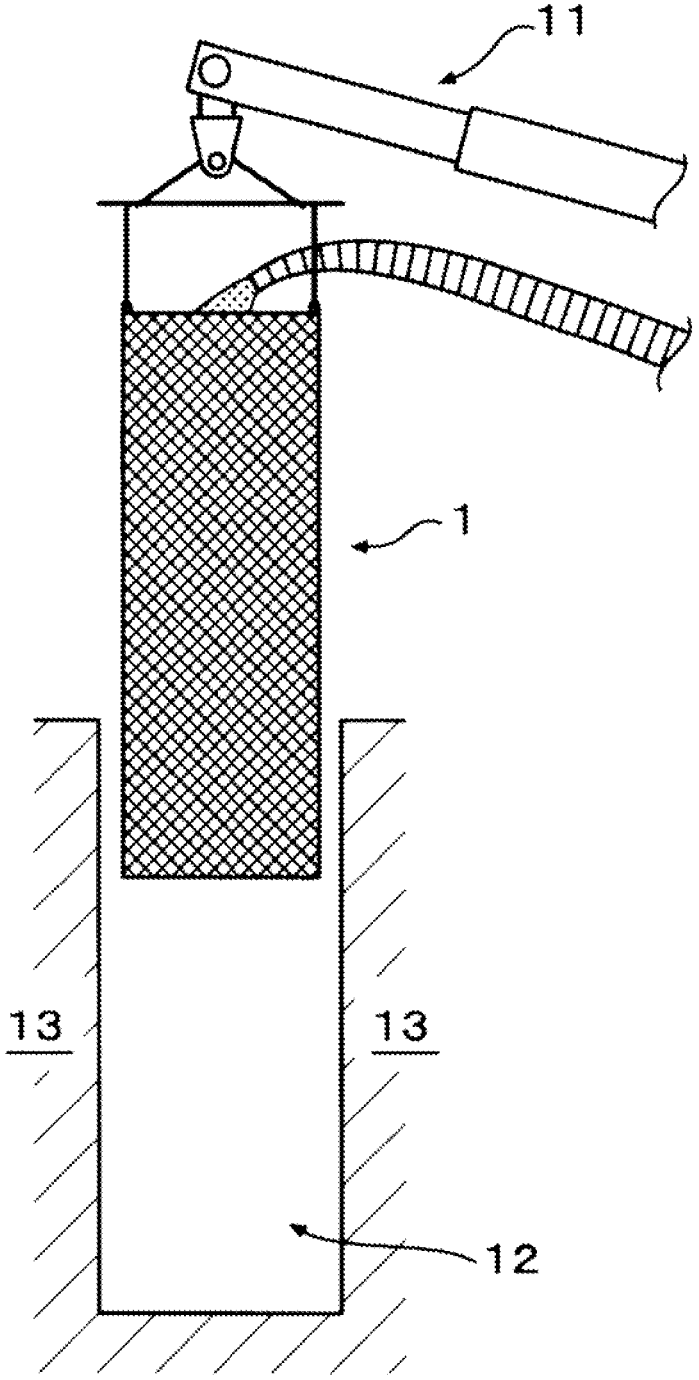
FIGS. 14A to 14C are explanatory diagrams illustrating an exemplary sequential procedure in which the tube is continuously or intermittently inserted upright into the borehole while the foundation pile forming material is continuously or intermittently filled into the tube in the suspended state.

In a construction method for a foundation pile according to a present embodiment, a tube 1 exemplified above is used, and the tube 1 including a forming material filling port 1*a* at a top end and a closed bottom 1*b* at a bottom end is set in a suspended state by a suspension means 11 vertically movable, such as a crane as illustrated in FIG. 14A.

Figure 14B:
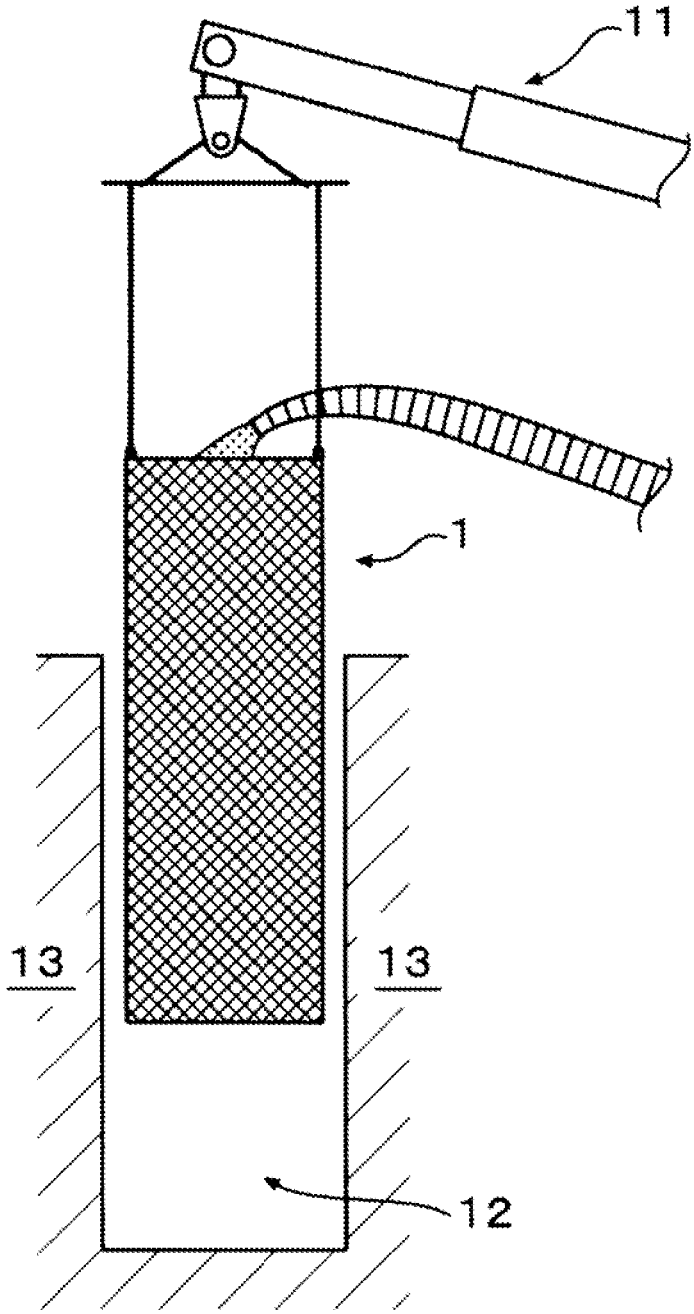

Further, as illustrated in FIGS. 14A and 14B, the tube 1 is inserted into a borehole 12 formed on the ground 13 while forming material 4 same as a first embodiment described above is continuously or intermittently is filled from the forming material filling port 1*a* into the tube 1 in the suspended state. Curing of the filled forming material 4 in the tube 1 is promoted inside the borehole 12, thereby integrating the tube 1 with the filled forming material 4, and a composite foundation pile 5 having reinforced rigidity is formed. The borehole 12 is formed to have a diameter larger than the tube 1.

According to the present embodiment, the tube 1 itself is continuously or intermittently inserted into the borehole 12 while the forming material 4 is filled into the tube 1 as described above, and curing of the filled forming material 4 in the tube 1 is promoted inside the borehole 12, thereby integrating the tube 1 with the forming material 4, and a composite foundation pile 5 having reinforced rigidity is formed.

Figure 14C:
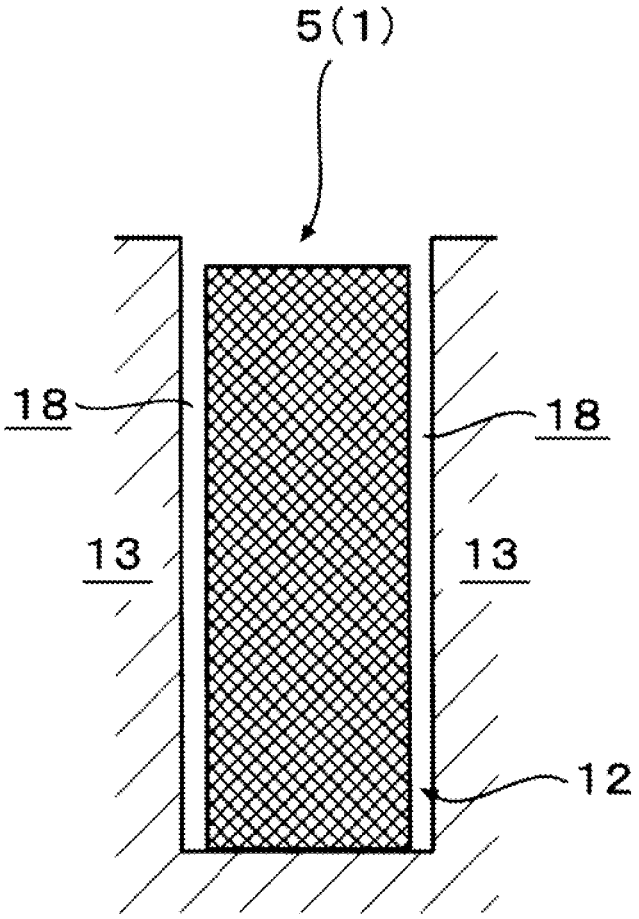

As described above, the composite foundation pile 5 is suspended and directly moved down as illustrated in FIG. 14C after the composite foundation pile 5 is formed while the tube 1 is set in the suspended state inside the borehole 12. Then, soil is backfilled into an annular space 18 between an inner peripheral surface of the borehole 12 and an outer peripheral surface of the composite foundation pile 5, thereby completing construction.

As described above, according to the construction method for a foundation pile related to the present invention, the robust and rigid foundation pile can be easily constructed by using the tube 1 formed of the material having flexibility.

Further, a bulging portion 8 is formed on a cylinder forming portion 1*c* of the tube 1, and the foundation pile having holding force to the ground 13 reinforced by the bulging portion 8 can be constructed.

REFERENCE SIGNS LIST

1 . . . Tube, 1*a* . . . Forming material filling port, 1*b* . . . Closed bottom, 1*c* . . . Cylinder forming portion, 2 . . . Fiber knitted body, 3 . . . Bundled fiber, 3*a* . . . Fiber, 4 . . . Forming material, 4' . . . Component of forming material, 5 . . . Composite foundation pile, 7 . . . Thin cylinder forming portion, 8 . . . Bulging portion, 9 . . . Projection, 10 . . . Reinforcing member, 10A . . . Vertical reinforcing member, 10B . . . Horizontal reinforcing member, 11 . . . Suspension means, 12 . . . Borehole, 13 . . . Ground, 14 . . . Support bar, 15 . . . Cylindrical support member, 15*a* . . . Flange, 16 . . . Load platform, 17 . . . Platform surface, 18 . . . Annular space

The invention claimed is:

1. A construction method for a foundation pile, the method comprising:

suspending a cylindrical tube having a forming material filling port at a top end of a cylinder forming portion and a closed bottom at a bottom end of the cylinder forming portion, wherein the closed bottom is integrated with the cylinder forming portion;

inserting the cylindrical tube into a borehole formed in the ground while filling the suspended cylindrical tube with a foundation pile forming material, wherein the cylindrical tube is filled with the foundation pile forming material via the forming material filling port while the cylindrical tube is suspended, and the cylindrical tube is configured to withstand the fill pressure of the foundation pile forming material such that a shape of the cylindrical tube is substantially maintained after being filled with the foundation pile forming material; and forming a composite foundation pile in which the tube and the filled forming material are integrated inside the borehole.

2. The construction method for a foundation pile according to claim 1, wherein the tube is formed of a fiber knitted body.

* * * * *